US006086334A

United States Patent [19]

Castel

[11] Patent Number: 6,086,334

[45] Date of Patent: Jul. 11, 2000

[54] METHOD OF OPERATING A BI-TURBOJETS POLYPHASIC PUMP WITH AXIAL THRUST CANCELLATION

[75] Inventor: Yvon Castel, Croissy sur Seine, France

[73] Assignee: Institut Francias du Petrole, Cedex, France

[21] Appl. No.: 09/128,542

[22] Filed: Aug. 4, 1998

Related U.S. Application Data

[62] Division of application No. 08/758,171, Nov. 25, 1996, Pat. No. 5,827,049, which is a continuation of application No. 08/445,779, May 22, 1995, abandoned.

[30] Foreign Application Priority Data

May 20, 1994 [FR] France ..... 94/06.300

[51] Int. Cl.[7] ..... F04F 5/00

[52] U.S. Cl. ..... 417/55; 417/171; 417/172; 417/76

[58] Field of Search ..... 417/54, 55, 171, 417/172, 178, 179, 194, 197, 76, 88, 65, 66, 67, 70, 72, 78; 60/270.1, 226.2; 239/451, 251

[56] References Cited

U.S. PATENT DOCUMENTS

| | | | |
|---|---|---|---|
| 1,273,948 | 7/1918 | Suczek | 417/72 |
| 1,280,276 | 10/1918 | Morse | 417/67 |
| 1,332,698 | 3/1920 | Vail | 417/72 |
| 1,758,376 | 5/1930 | Sawyer | 417/197 |
| 2,938,658 | 5/1960 | Foster | 417/171 |
| 3,046,732 | 7/1962 | Foa | 417/171 |
| 3,361,336 | 1/1968 | Foa | 417/54 |
| 3,370,423 | 2/1968 | Vaughan | 417/76 |
| 3,395,854 | 8/1968 | Martin et al. | 417/54 |
| 3,614,037 | 10/1971 | Vdolek | 239/265.13 |
| 4,003,678 | 1/1977 | David | 417/88 |
| 4,239,155 | 12/1980 | Foa | 239/265.17 |
| 4,865,518 | 9/1989 | Foa | 417/54 |
| 5,151,112 | 9/1992 | Pike | 55/230 |
| 5,205,119 | 4/1993 | Bulman | 60/269 |
| 5,616,006 | 4/1997 | Castel | 417/54 |
| 5,827,049 | 10/1998 | Castel | 417/171 |

FOREIGN PATENT DOCUMENTS

| | | | |
|---|---|---|---|
| 157411 | 12/1932 | Switzerland | 417/72 |

*Primary Examiner*—Ted Kim

*Attorney, Agent, or Firm*—Antonelli, Terry, Stout & Kraus, LLP

[57] ABSTRACT

A pumping device providing direct energy exchange between a working fluid and a pumped fluid, comprising at least a first ejector propelling the working fluid in one direction and at least a second ejector propelling working fluid in a second direction. The axial thrust induced by the jet emitted in the first direction compensates at least partly that of a jet emitted in the second direction by another ejector.

39 Claims, 3 Drawing Sheets

METHOD OF OPERATING A BI-TURBOJETS POLYPHASIC PUMP WITH AXIAL THRUST CANCELLATION

CROSS-REFERENCE TO RELATED APPLICATIONS

This application is a Divisional of application Ser. No. 08/758,171, filed on Nov. 25, 1996, now U.S. Pat. No. 5,827,049 which application is Continuation of application Ser. No. 08/445,779, filed on May 22, 1995 (now abandoned).

BACKGROUND OF THE INVENTION

1. Field of the Invention

The present invention relates to a method and to a device allowing to increase the pumping and the thrust performance for devices in which an induced fluid is used for driving another fluid by direct moment and energy transfers.

2. Description of the Prior Art

U.S. Pat. No. 4,485,518 by FOA describes a method and a device in which a direct energy transfer is efficiently performed between a primary fluid or working fluid and a fluid that is to be transferred over a certain distance. The improvement brought by FOA in relation to patent U.S. Pat. No. 3,046,732 by the same claimant consists in splitting the working fluid into two parts, in ejecting a first part through ports located on a rotor towards a fluid to be conveyed, and in using the fluid jet resulting from the second part of the working fluid passing through a central port for driving the first part of the working fluid and the fluid to be conveyed. This procedure minimizes shear in a fluid at the surface of a mechanical part and therefore possible fluid backflows which decrease the pumping efficiency of such a device. The bearings and the thrusts allowing rotation of the rotor are in contact with the fluid to be conveyed.

The prior art described in FIG. 1 comprises a rotary jet device in which a working fluid P under pressure is fed through a pipe 1' into a rotor 2' in which a major part of the working fluid flows our through ejectors 3' located on the rotor in the form of jets having an inclined direction so that the jets obtained cause rotor 2' to rotate. The rotor 2' is supported by a fixed external housing 7' by means for bearings 8' ensuring the rotation of rotor. Another part of the working fluid passes through a central pipe 10' prior to being mixed with an auxiliary fluid fed in through ports located in housing 7'. An interaction space 5' allows the mixing of the part derived through ejectors 3' and the passing of the mixture delivered by the central jet with the primary fluid K.

Such a device is not useful when the working fluid exhibits a high pressure and when the rotating speed of the rotor is high, because of the presence of bearings which wear out very quickly as a result of the motion of rotation and of the power of the jets.

The use of such bearings is inappropriate for applications where the fluids have high energies. In fact, the rotating speed of the rotor combined with the one-way ejection of fluids having high power values leads to a rapid wearing of the bearings and of the thrusts.

Moreover, the presence of particles, for example solid particles such as sand, decreases the reliability of such a device.

SUMMARY OF THE INVENTION

The present invention overcomes such drawbacks and notably improved the life of the parts allowing the rotation of a rotor with respect to a housing in which it is located when the fluids used have high power.

The object of the present invention is thus a simple, robust and reliable machine for improving the thrust and pumping devices, notably by preventing the wear of parts stressed by strong axial thrusts resulting from fluids having high energies.

The present invention can notably be used in the field for production of heavy crudes.

In accordance with the present invention, the device providing this result comprises a piece rotating freely about an axis, the piece comprising at least two means for propelling the working fluid, said piece being connected to a pipe for feeding in a working fluid under pressure, a fixed housing arranged around said freely rotating piece so as to create a mixing space between said working fluid and a primary fluid, said piece being fitted with at least one port for feeding said primary fluid into the mixing space. The first means propells at least part of the working fluid emitted by an injector in a first direction and the second means propells at least part of said working fluid emitted by another injector in a second direction so that the axial thrust induced by a first jet emitted in the first direction compensates at least partly that substantially a second jet emitted in the second direction.

The first means of the second means form respectively an angle and of substantially 180°—with respect to the axis so that the direction of the first jet and the direction of the second jet are opposite.

The freely rotating piece is for example supported with respect to the working fluid feed pipe by means of fluid bearings and thrusts.

The number of means for propelling working fluid is even and can be selected according to at least one characteristic of the working fluid.

The device comprises for example a primary fluid draw-off device connected to the pipe for feeding in the working fluid.

The device can be located inside a casing, and/or between two casing elements.

The dimension and the geometry of the feed ports for feeding in the fluid to be propelled are for example determined from at least one characteristic of the primary fluid.

The present invention also relates to a method which allows imparting to a primary fluid a certain energy by direct energy exchange between a working fluid and the primary fluid. The working fluid is ejected in the form of several subjets substantially simultaneously in a first direction and in a second opposite direction so that the thrust induced by a jet emitted in the first direction balances substantially that of a jet emitted in the second direction.

The subjets are ejected in substantially opposite directions.

The method and the device for implementing the method is particularly well suited for the pumping of a multiphase fluid comprising a gas phase, a liquid phase and a solid phase, such as sand, and notably the pumping of a petroleum type effluent from a well.

The different advantages provided by the invention include an increase in the life of the rotating pieces, for example by fluids having very high pressure values.

BRIEF DESCRIPTION OF THE DRAWINGS

Other features and advantages of the present invention will be clear from reading the description hereafter given by way of non limitative examples, with reference to the accompanying drawings in which.

DESCRIPTION OF THE PREFERRED EMBODIMENTS

Figure 2:
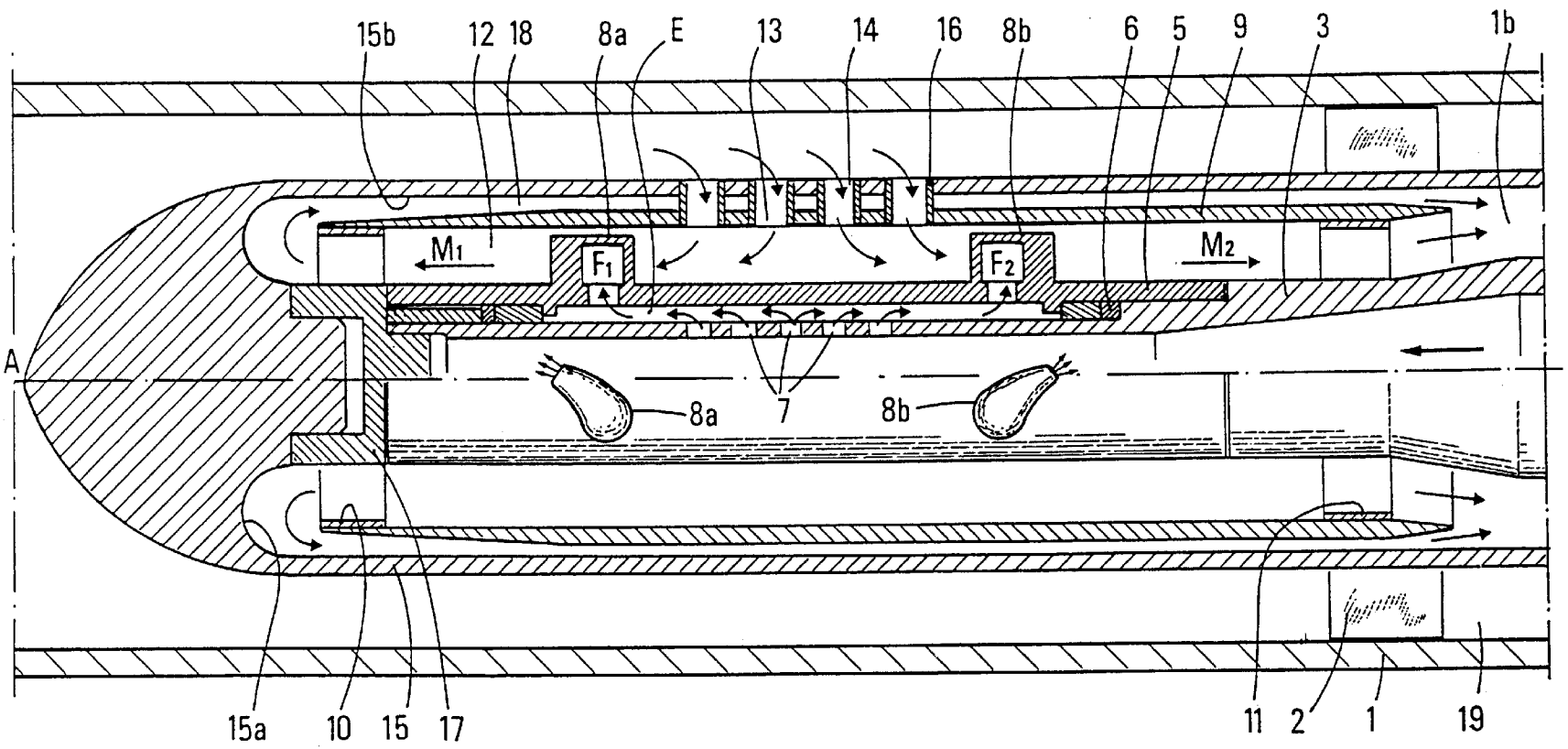
FIG. 2 illustrates a preferred embodiment according to the invention, and FIG. 3 diagrammatically shows the device used as a booster for propelling an effluent flowing in a pipe.

FIG. 2 shows an embodiment of the present invention which is an improvement over the prior art cited above, notably by minimizing the wear of the rotating parts.

A device according to the invention is for example located in a casing 1 in which circulates a fluid hereafter called a primary fluid to which it is desired to impart a certain energy in order to transfer it from one place to another.

The device is supported with respect to casing 1 by means of an annular piece 2 and comprises an inner or feed pipe 3 into which a working fluid under pressure coming from an outer source, which is not shown, is fed. A piece 5 having preferably the shape of a cylindrical housing is positioned for example coaxially with respect to the axis A of feed pipe 3. The inside diameter of the cylindrical housing 5 is greater than the outside diameter of feed pipe 3 so as to create an annular space E between these two pieces. Ports 7 pierced in feed pipe 3 allow the working fluid to flow towards this annular space E. Connection of piece 5 with feed pipe 3 is provided for example by an assembly 6 that can consist of a fluid bearing and a fluid thrust, this type of bearings and thrusts minimizing the frictions existing between rotating pieces such as pieces 3 and 5.

Piece 5 also comprises at least two ejection means such as ejectors 8*a* and 8*b*, allowing ejection of the working fluid from the annular space E towards the primary fluid circulating in casing 1.

Piece 5 rotates freely. As a result of this motion of rotation, the fluid jets coming from ejectors 8*a* and 8*b* have, for example, the shape of helicoids that allow the energy to be transferred to the primary fluid to be propelled.

A fixed cylindrical housing 9 is arranged preferably coaxially to piece 5 and is supported with respect thereto for example by means of a piece 10 allowing its lower centering and a piece 11 allowing its upper centering. Piece 5 and housing 9 are positioned so as to create a mixing space 12. In this space 12, the working fluid being fed in by ejectors 8*a* and 8*b* in the form of two subfluids F1 and F2 which, have amounts which are being substantially identical, mix with the primary fluid circulating in casing 1 and fed into space 12 as described hereafter. Two submixtures having substantially opposite directions of circulation in space 12 are thus obtained.

A piece 15 such as a tubing forms the outer wall of the device. It is provided with ports 13 and ports 14 located respectively on either side of the walls of the tubing, and which communicate together by means, for example, of inserts 16 connecting a port 13 to a port 14. The primary fluid circulating in casing 1 thus passes through a port 14, an insert 16 and a port 13 prior to entering the mixing space 12. The three pieces 13, 14 and 16 are preferably aligned.

When the piece 2 intended for supporting the pumping device with respect to the casing is a packing insulating piece 15 from casing 1, the backflow occurs for example in the annular space 19 contained between casing 1 and the working fluid feed pipe 3.

According to another embodiment, piece 2 is a piece intended for centering tubing 15 in casing 1. The backflow then occurs in the annular space 1*b* contained between tubing 15 and feed pipe 3, which can be a coiled tubing.

The two working subfluids F1 and F2 suck in the primary fluid fed into space 12 and carry it along by forming two submixtures M1 and M2 having substantially opposite directions of circulation.

The submixture M1 flows out for example through one of the ends of mixing space 12 prior to passing into the space 18 formed by pieces 9 and 15. It opens into a pipe 1*b* connecting spaces 12 and 18 to the circulation pipe 1.

The submixture M2 flows out at the opposite end with respect to the previous one, directly, for example, into pipe 1*b*.

Piece 15 is connected to the central feed pipe 3 of the device for example by means of a piece 17 forming notably a seal between the different pieces 3, 5, 9, 15 of the device. The layout of these pieces and the seal obtained with piece 17 are such that the working fluid passes mainly through ejectors 8*a* and 8*b* by producing two subfluids F1 and F2, and the main part of the submixtures M1 and M2 flows from the mixing space 12 to the annular space 18 or directly into pipe 16. The subfluids F1 and F2 and the two submixtures M1 and M2 are channelled thereby.

The direction of fluid flow produced respectively by ejectors 8*a* and 8*b*, as represented by the arrows representing fluid flows of mixtures M1 and M2, subtends an angle of approximately 180° as illustrated in FIG. 2. The working fluid jets ejected into the mixing space located between pieces 5 and 9 by ejectors 8*a* have a substantially opposite direction with respect to that of the working fluid jets passing through ejectors 8*b*. This procedure allows a balancing of the fluid drive resulting from the high energy of the jets from ejectors 8*a* having a first direction with that of the fluids coming from ejectors 8*b* having a second opposite direction.

As a result of the angle between the fluid submixtures from ejectors 8*a* and 8*b*, and of the motion of rotation of piece 5, the working fluid jets come out of ejectors 8*a* and 8*b* for example in a helical form. These jets therefore fulfil a function substantially identical to that of the mechanical blades commonly used in thrust devices, while avoiding the mechanical problems that may be encountered.

The number of working fluid jets having opposite directions and produced by a device according to the invention is preferably an even number. Such a choice imparts symmetry to the device because the subfluid jets emitted in each direction are identical, which substantially balances the thrusts resulting from the power of the working fluid jets such as axial thrusts.

The number of ejectors 8*a*, 8*b* is for example selected according to the working fluid, for example as a function of its viscosity.

The inner wall of piece 15 located in the vicinity of piece 17 comprises for example three parts 15*a* and 15*f*.

Part 15*a* fits the sealing piece 17. It is extended on either side by part 15*b* having preferably a rounded shape.

The rounded shape of part 15*a* is suited for allowing the submixture M1 to pass from space 12 to space 18 with a minimum of pressure drop while avoiding shearing effects.

The use of such a symmetrical system comprising at least two ejectors 8*a*, 8*b* producing working fluid jets in substantially opposite directions minimizes the unbalance resulting from the thrust, for example the axial thrust, which can be great when the fluids have high pressure values.

The number of working fluid jets created to propel the primary fluid depends on the energy to be transmitted to the primary fluid because the outgoing speed is deliberately limited in order to greatly decrease abrasive wear phenomena and to avoid cavitation phenomena, both detrimental to a good reliability of the device.

The angle of inclination of ejectors 8*a* and 8*b* with respect to the axis A of the device can be selected as a function of the rotating speed desired for the working fluid jets, in order to obtain the optimum energy efficiency during the energy transfer between the working fluid and the primary fluid.

The working fluid is generally a fluid having a low viscosity in relation to the viscosity of the primary fluid. The working fluid proportion is selected as a function of the viscosity of the primary fluid in order to obtain a working fluid and primary fluid mixture that can be conveyed without excessive pressure drop linked to the viscosity of the mixture.

The proportion of working fluid fed into the mixing space 12 is controlled, for example, by the number of ports 7 located on the feed pipe 3 and by the number of ejectors 8*a* and 8*b*.

It is also possible to control the feeding of the primary fluid by selecting the number of ports 13 and 14.

For viscous primary fluids, this procedure is advantageous and allows a better fluidity of the mixture to be obtained if the working fluid available is limited.

The dimension and the geometry for ports 13 and 14 is determined as a function of the nature of the primary fluid to be propelled and of the pressure of this fluid. For a petroleum type multiphase fluid, it is therefore advisable to take account of the possible presence of solid particles.

The working fluid can be a fluid of miscible type or not. It can include products such as inhibitors commonly used for example in the petroleum field, anticorrosion products, antihydrates, products capable of preventing the formation of asphaltenes or of any other depositions resulting notably from changes in pressure and temperature. The presence of such products improves the reliability of the pumping devices.

The working fluid can be taken from the primary fluid circulating in casing 1.

Figure 4:
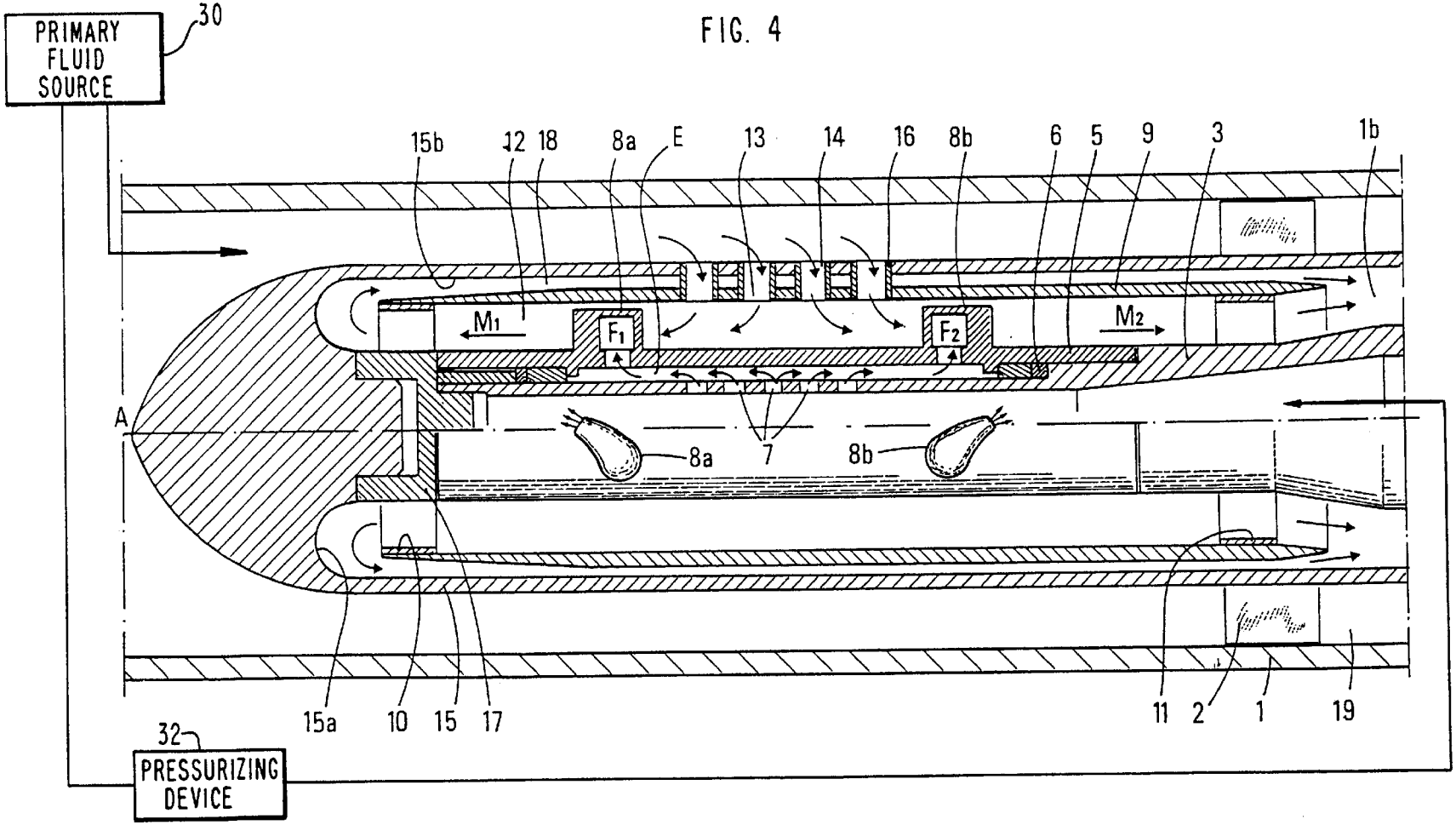
FIG. 4 illustrates the device in combination with a fluid pressurizing device and a primary fluid source.

In this case, the device comprises, for example, a system as illustrated schematically in FIG. 4 for drawing off a certain amount of primary fluid and for bringing it to a sufficient pressure value so that it can be used as a working fluid before recycling it.

The primary fluid source 30 provides fluid to a pressurizing device 32 which pressurizes the fluid which is inputted as a working fluid.

In another embodiment, the present device can also be positioned at the end for example of a coiled tubing placed in vertical or horizontal petroleum type effluent wells.

Figure 1:
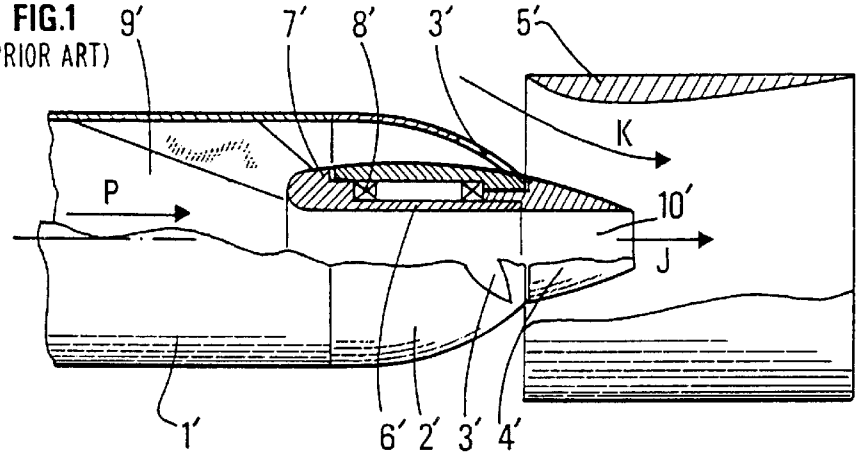
FIG.1 (PRIOR ART)
FIG. 1 illustrates the prior art constituting patent U.S. Pat. No. 4,239,155.
Figure 3:
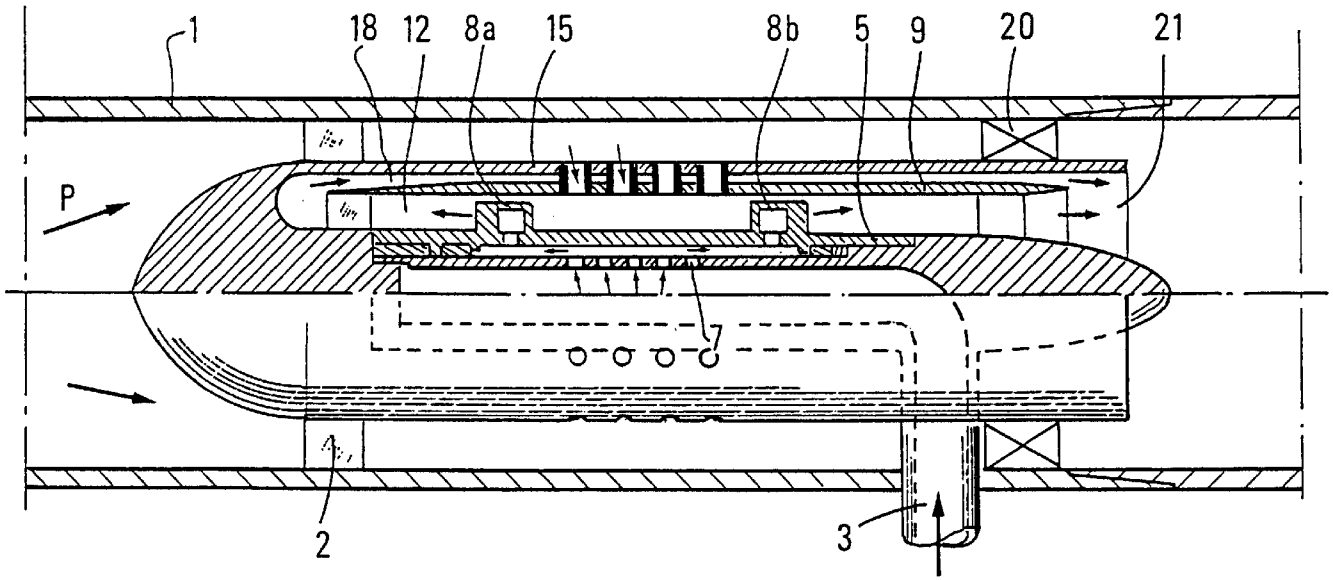

FIG. 3 illustrates an example of the device used as a booster.

The device according to the invention is advantageously used as a booster for conveying petroleum effluents flowing in a pipe, for example from a source such as a well to a processing location.

FIG. 3 shows the device described in FIG. 2 positioned in casing 1 for example. The device is held up with respect to casing 1 by means such as a packing 20. Casing 1 comprises for example an opening allowing passage of pipe 3 feeding the working fluid coming from an external source.

The device positioned in this way allows energy to be imparted to a fluid circulating in the casing for example in the direction shown by arrow P.

The petroleum effluent to be propelled or primary fluid circulating in casing 1 in the direction shown by arrow P for example passes through the device as described in FIG. 2, where it acquires a certain amount of energy. During this mixing, a direct energy exchange has occurred between the working fluid and the primary fluid, the mixture then flows out at the end 21 of the device with a sufficient energy ensuring its conveyance to a processing or reception location for example, that is not shown.

I claim:

1. A method of imparting energy to a primary fluid, by direct energy exchange with a working fluid within an annular mixing zone extending along a longitudinal axis of a rotating pumping device, comprising:

emitting at least a part of the working fluid from a rotating jet located within the annular mixing zone at a stationary longitudinal location relative to a longitudinal axis of rotation of the rotating jet in a first direction substantially parallel to the axis, emitting at least a part of the working fluid from a rotating jet located within the annular mixing zone at a stationary longitudinal location relative to the longitudinal axis in a second substantially opposite direction substantially parallel to the axis; and wherein the working fluid is fed in a first radial direction toward the rotating jets prior to emission by the radial jets and the primary fluid is fed in a second radial direction opposite to the first radial direction into the annular mixing zone; and thrust along the longitudinal axis induced by the first jet emitting the working fluid in the first direction cancels at least part of thrust along the longitudinal axis induced by the second jet emitting the working fluid in the second direction, and each rotating jet is further located at a fixed circumferential location offset radially from the longitudinal axis during rotation and at least one part of the working fluid is taken from the primary fluid, the primary fluid being pressurized to a sufficient pressure value to function as the working fluid.

2. A method as claimed in claim 1 wherein:

the primary fluid is a polyphasic fluid.

3. A method in accordance with claim 2 wherein:

the primary fluid is fed radially inward into the annular mixing zone between the jets and the working fluid is fed radially outward.

4. A method in accordance with claim 3 wherein:

the working fluid is fed radially outward into the jets which emit the working fluid in the first and second directions into the annular mixing zone.

5. A method in accordance with claim 4 wherein:

the working fluid changes direction by an acute angle between entering the jets and being emitted by the jets into the annular mixing zone.

6. A method in accordance with claim 2 wherein:

the polyphasic fluid comprises solid particles.

7. A method in accordance with claim 6 wherein:

the primary fluid is a petroleum effluent.

8. A method in accordance with claim 7 wherein:

the primary fluid is fed radially inward into the annular mixing zone between the jets and the working fluid is fed radially outward.

9. A method in accordance with claim 8 wherein:

the working fluid is fed radially outward into the jets which emit the working fluid in the first and second directions into the annular mixing zone.

10. A method in accordance with claim 9 wherein:

the working fluid changes direction by an acute angle between entering the jets and being emitted by the jets into the annular mixing zone.

11. A method in accordance with claim 6 wherein:

the primary fluid is fed radially inward into the annular mixing zone between the jets and the working fluid is fed radially outward.

12. A method in accordance with claim 11 wherein:

the working fluid is fed radially outward into the jets which emit the working fluid in the first and second directions into the annular mixing zone.

13. A method in accordance with claim 12 wherein:

the working fluid changes direction by an acute angle between entering the jets and being emitted by the jets into the annular mixing zone.

14. A method in accordance with claim 2 wherein:

the primary fluid is a petroleum effluent.

15. A method in accordance with claim 1 wherein:

the primary fluid comprises solid particles.

16. A method in accordance with claim 15 wherein:

the primary fluid is fed radially inward into the annular mixing zone between the jets and the working fluid is fed radially outward.

17. A method in accordance with claim 16 wherein:

the working fluid is fed radially outward into the jets which emit the working fluid in the first and second directions into the annular mixing zone.

18. A method in accordance with claim 17 wherein:

the working fluid changes direction by an acute angle between entering the jets and being emitted by the jets into the annular mixing zone.

19. A method in accordance with claim 15 wherein:

the primary fluid is a petroleum effluent.

20. A method in accordance with claim 19 wherein:

the primary fluid is fed radially inward into the annular mixing zone between the jets and the working fluid is fed radially outward.

21. A method in accordance with claim 20 wherein:

the working fluid is fed radially outward into the jets which emit the working fluid in the first and second directions into the annular mixing zone.

22. A method in accordance with claim 21 wherein:

the working fluid changes direction by an acute angle between entering the jets and being emitted by the jets into the annular mixing zone.

23. A method in accordance with claim 1 wherein:

the primary fluid is fed radially inward into the annular mixing zone between the jets and the working fluid is fed radially outward.

24. A method in accordance with claim 23 wherein:

the working fluid is fed radially outward into the jets which emit the working fluid in the first and second directions into the annular mixing zone.

25. A method in accordance with claim 24 wherein:

the working fluid changes direction by an acute angle between entering the jets and being emitted by the jets into the annular mixing zone.

26. A method in accordance with claim 1 wherein:

the primary fluid is a petroleum effluent.

27. A method of imparting energy to a primary fluid, by direct energy exchange with a working fluid within an annular mixing zone extending alone a longitudinal axis of a rotating pumping device, comprising:

emitting at least a part of the working fluid from a rotating jet located within the annular mixing zone at a stationary longitudinal location relative to a longitudinal axis of rotation of the rotating jet in a first direction substantially parallel to the axis, emitting at least a part of the working fluid from a rotating jet located within the annular mixing zone at a stationary longitudinal location relative to the longitudinal axis in a second substantially opposite direction substantially parallel to the axis; and wherein the working fluid is fed in a first radial direction toward the rotating jets prior to emission by the radial jets and the primary fluid is fed in a second radial direction opposite to the first radial direction into the annular mixing zone; and thrust along the longitudinal axis induced by the first jet emitting the working fluid in the first direction cancels at least part of thrust along the longitudinal axis induced by the second jet emitting the working fluid in the second direction, and each rotating jet is further located at a fixed circumferential location offset radially from the longitudinal axis during rotation and at least one part of the working fluid is taken from the primary fluid, the primary fluid being pressurized to a sufficient pressure value to function as the working fluid.

28. A method in accordance with claim 27 wherein:

the polyphasic fluid comprises solid particles.

29. A method in accordance with claim 28 wherein:

the primary fluid is fed radially inward into the annular mixing zone between the jets and the working fluid is fed radially outward.

30. A method in accordance with claim 29 wherein:

the working fluid is fed radially outward into the jets which emit the working fluid in the first and second directions into the annular mixing zone.

31. A method in accordance with claim 30 wherein:

the working fluid changes direction by an acute angle between entering the jets and being emitted by the jets into the annular mixing zone.

32. A method in accordance with claim 28 wherein:

the primary fluid is a petroleum effluent.

33. A method in accordance with claim 32 wherein:

the primary fluid is fed radially inward into the annular mixing zone between the jets and the working fluid is fed radially outward.

34. A method in accordance with claim 33 wherein:

the working fluid is fed radially outward into the jets which emit the working fluid in the first and second directions into the annular mixing zone.

35. A method in accordance with claim 34 wherein:

the working fluid changes direction by an acute angle between entering the jets and being emitted by the jets into the annular mixing zone.

36. A method in accordance with claim 27 wherein:

the primary fluid is fed radially inward into the annular mixing zone between the jets and the working fluid is fed radially outward.

37. A method in accordance with claim 36 wherein:

the working fluid is fed radially outward into the jets which emit the working fluid in the first and second directions into the annular mixing zone.

38. A method in accordance with claim 37 wherein:

the working fluid changes direction by an acute angle between entering the jets and being emitted by the jets into the annular mixing zone.

39. A method in accordance with claim 27 wherein:

the primary fluid is a petroleum effluent.

* * * * *